US006662617B2

(12) United States Patent
Fahrenbach

(10) Patent No.: US 6,662,617 B2
(45) Date of Patent: Dec. 16, 2003

(54) PRESS FOR TRANSFORMING WORK PIECES

(75) Inventor: Juergen Fahrenbach, Aichelberg (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/949,897

(22) Filed: Sep. 12, 2001

(65) Prior Publication Data

US 2003/0046970 A1 Mar. 13, 2003

(30) Foreign Application Priority Data

Sep. 12, 2000 (DE) ..... 100 45 312

(51) Int. Cl.[7] ..... B21J 13/14
(52) U.S. Cl. ..... 72/345; 72/432
(58) Field of Search ..... 72/1, 3, 19.9, 345, 72/432

(56) References Cited

U.S. PATENT DOCUMENTS 2,522,451 A * 9/1950 Johansen ..... 72/432
3,160,089 A * 12/1964 Platou ..... 72/432
3,481,171 A * 12/1969 Alexander et al. ..... 72/432
3,825,811 A * 7/1974 Smith et al. ..... 72/19.9
3,955,396 A * 5/1976 Carrieri ..... 72/432

FOREIGN PATENT DOCUMENTS

DE 19701282 A1 7/1998

* cited by examiner

*Primary Examiner*—Lowell A. Larson
(74) *Attorney, Agent, or Firm*—Crowell & Moring LLP

(57) ABSTRACT

A press for transforming work pieces including a drive apparatus for driving at least one press tappet and at least one tappet element. The drive apparatus is connected with at least one extractor element through a lever linkage. A tool with a tool lower element and a tool upper element which is mounted on the press tappet. At least one extractor element is provided to extract the work piece following the transformation process. A coupling which connects the drive apparatus with at least one extractor element or disengages it therefrom. At least one measuring sensor which is part of a triggering apparatus arranged inside the lever linkage and which is in a position to measure the force acting on the extractor element continuously. The triggering apparatus is provided to disengage the coupling in the event of a deviation of the force value measured continuously by at least one measuring sensor from a force standard value specified in reference to a certain point in the motion of the extractor element by a certain amount.

13 Claims, 6 Drawing Sheets

PRESS FOR TRANSFORMING WORK PIECES

This application claims the priority of Germany Application No. 10045312.0 filed Sep. 12, 2000, the disclosure of which is expressly incorporated by reference herein.

BACKGROUND AND SUMMARY OF THE INVENTION

The invention relates to a press as well as a process for transforming work pieces.

A press with a safety shutdown is known from DE 197 01 282 A1 where the drive of the tappet is disengaged by means of a coupling apparatus which receives a signal from a monitoring apparatus if the force exerted upon the tappet deviates from a specified standard value by more than a specified amount. Among other things, it can also be provided with this press that the monitoring apparatus shuts down one or more extractors.

But it is not indicated in this document how this shutdown of the extractor is to be undertaken. It is, however, unambiguous that the shutdown can only be undertaken in connection with shutting down the tappet and consequently can only be undertaken only when a disturbance arises in the area of the tappet.

It is the object of the present invention to create a press for transforming work pieces where in the event of a disturbance in the area of the extractor elements, damage to the extractor elements of the entire press are avoided.

Through at least one measuring sensor which in accordance with the invention is arranged within the lever linkage, the force acting upon at least one extractor element is measured, owing to which at any point in time there is a monitoring on the sequence of the extraction process.

In this way, the triggering apparatus of the invention having the measuring sensor can then disengage the coupling if the height of the force measured deviates from a standard force value specified at a certain point of the motion of the extractor element by a specific amount. In this way, in the event of a disturbance in the area of at least one extractor element, the drive apparatus is disconnected from the extractor element, and the extractor element is shut down. In this way, damage to the extractor element or the entire press can be avoided in cases in which disturbances arise in the region of the extractor element.

Through the process of the invention for transforming work pieces, it is possible to shut down the extractor element already before reaching a maximal force, since already when a certain tolerance is exceeded, that is, a recognizable tendency toward higher emerging forces, the flow of power between the drive apparatus and the extractor element is interrupted.

In an advantageous refinement of the process of the invention, the possibility offers itself of undertaking an adaptation of the force standard values for each operating point in connection with changes of the force acting from the drive apparatus on the extractor element which can arise owing to the shape of the lever linkage. Here the functions of the force or the path of the drive apparatus traversed and the extractor element are adapted to each other, which can be designated as "dynamization."

BRIEF DESCRIPTION OF THE DRAWINGS

Further advantageous configurations and refinements of the invention emerge from the remaining dependent claims as well as the embodiment represented below on the basis of the drawings in terms of principles, wherein:

FIG. 5 shows an extractor element with a part of the associated lever linkage in a second embodiment; and.

DETAILED DESCRIPTION OF THE PREFERRED EMBODIMENT

Figure 1:
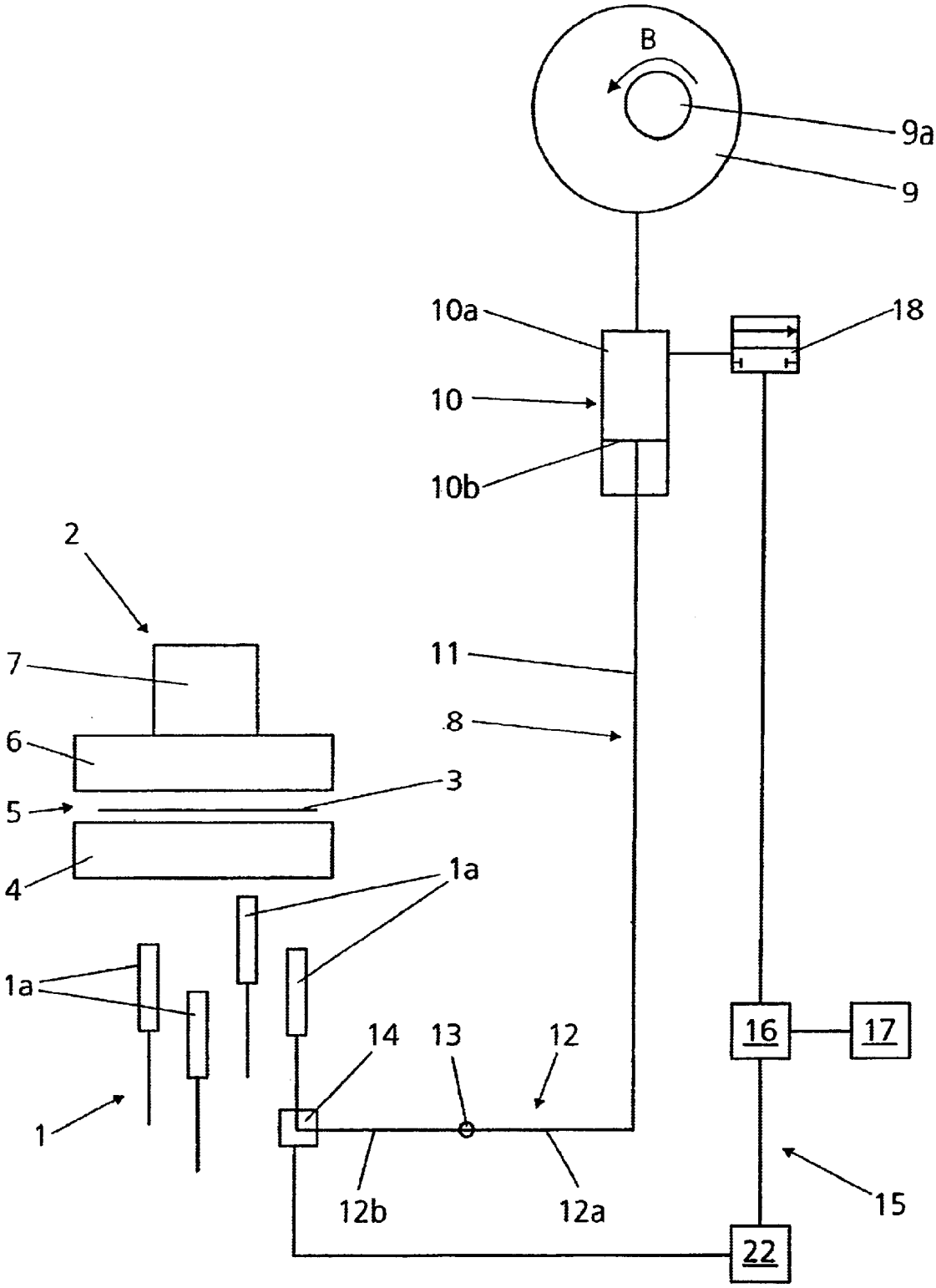
FIG. 1 is a schematic representation of an extraction system of the press of the invention.

FIG. 1 shows an extractor system 1 which has several rod-like extractor elements 1*a*. The extractor system 1 is a component of a press for transforming work pieces 3, and the extractor elements 1*a* are provided to extract the work pieces 3 out of a lower tool 4 which is an element of a further tool 5. The tool 5 moreover has an upper tool 6 in an inherently familiar manner which is or can be provided with an extractor system 1 in a way not represented and is installed on a tappet 7. The tappet 7 executes a stroke motion characterized with an arrow "A" in order to transform the work pieces 3, and is for this purpose connected with a not represented drive apparatus. Basically an eccentric press, a toggle-lever press or any other desired press 2 can be used as press 2.

The extractor system 1 or the extractor elements 1*a* are connected with a drive apparatus 9 through a lever linkage 8 whereby the drive facility 9 is either connected with the aforementioned drive facility for the tappet 7 or is identical with the same. The drive apparatus 9, here a curve-controlled eccentric drive apparatus, has a drive shaft 9*a* which rotates in accordance with the arrow designated with "B." Between the drive apparatus 9 and the lever linkage 8, there is located a coupling 10, which is the present case is formed by a hydraulic piston/cylinder unit, and has a cylinder 10*a* as well as a piston 10*b*. An actuation lever 11 is mounted on the piston 10*b* which is connected with a rocker arm 12 or acts upon the same. The rocker arm 12 consists of two arms 12*a* and 12*b* which are arranged on both sides of an approximately central point of rotation 13 of the rocker arm 12, whereby arm 12*a* is installed on actuation lever 11 and arm 12*b* actuates an individual extractor element 1*a*. In the present case, the extractor elements 1*a* are thus activated when the piston 10*a* moves out and consequently exerts pressure on the actuation lever 11. As already mentioned above, the work piece 3 is ejected in this way. Of course, a moving out of the extractor element 1*a* when piston 10*b* moves in, and consequently a traction stress upon the actuation lever 11, would also be possible.

Between arm 12*b* of the rocker arm 12 and extractor element 1*a,* a measuring sensor 14 is situated, which is part of a triggering apparatus 15. Moreover, the triggering apparatus 15 has an evaluation apparatus 16 connected with the measuring sensor as well as a memory apparatus 17 and a valve 18. The measuring sensor 14 is in a position to measure continuously the force acting on the extractor element 1*a,* and forwards the force measured to the evaluation apparatus 16. In the evaluation apparatus 16, the force values measured are constantly compared with standard values entered into the memory apparatus 17 for forces arising in the normal case and with a deviation of a measured force value by a specific value from the associated standard value, the triggering apparatus 15 ensures that the coupling 10 is disengaged. The amount by which the actual force values may deviate from the stored standard values is stored in the memory apparatus 17 as so called envelopes and can be freely programmed for any point. If several evaluation elements la with assigned lever linkages 8 are present, as this is here the case, then each of these extractor elements 1*a* is allocated a corresponding trigger apparatus 15. Of course, only one extractor element 1*a* could be provided.

For disengaging the coupling 10, the evaluation apparatus 16 emits a signal to valve 18 constructed as a quick breaking 2/2 way valve which then within a very short time switches over and consequently ensures that the cylinder 10*a* becomes pressureless. In this way, the coupling 10 can transfer no more force to the actuation lever 11, and the extractor element 1*a* likewise becomes power-free. Such a deviation of actual force from the associated standard value can arise in connection with disturbances in the area of an individual extractor element 1*a* or also in the area of the entire extractor system 1. Through the disengagement of the coupling 10 described, the extractor elements 1*a* are no longer driven by drive apparatus 9, owing to which damage to extractor elements 1*a* and the entire press 2 are avoided.

Figure 2:
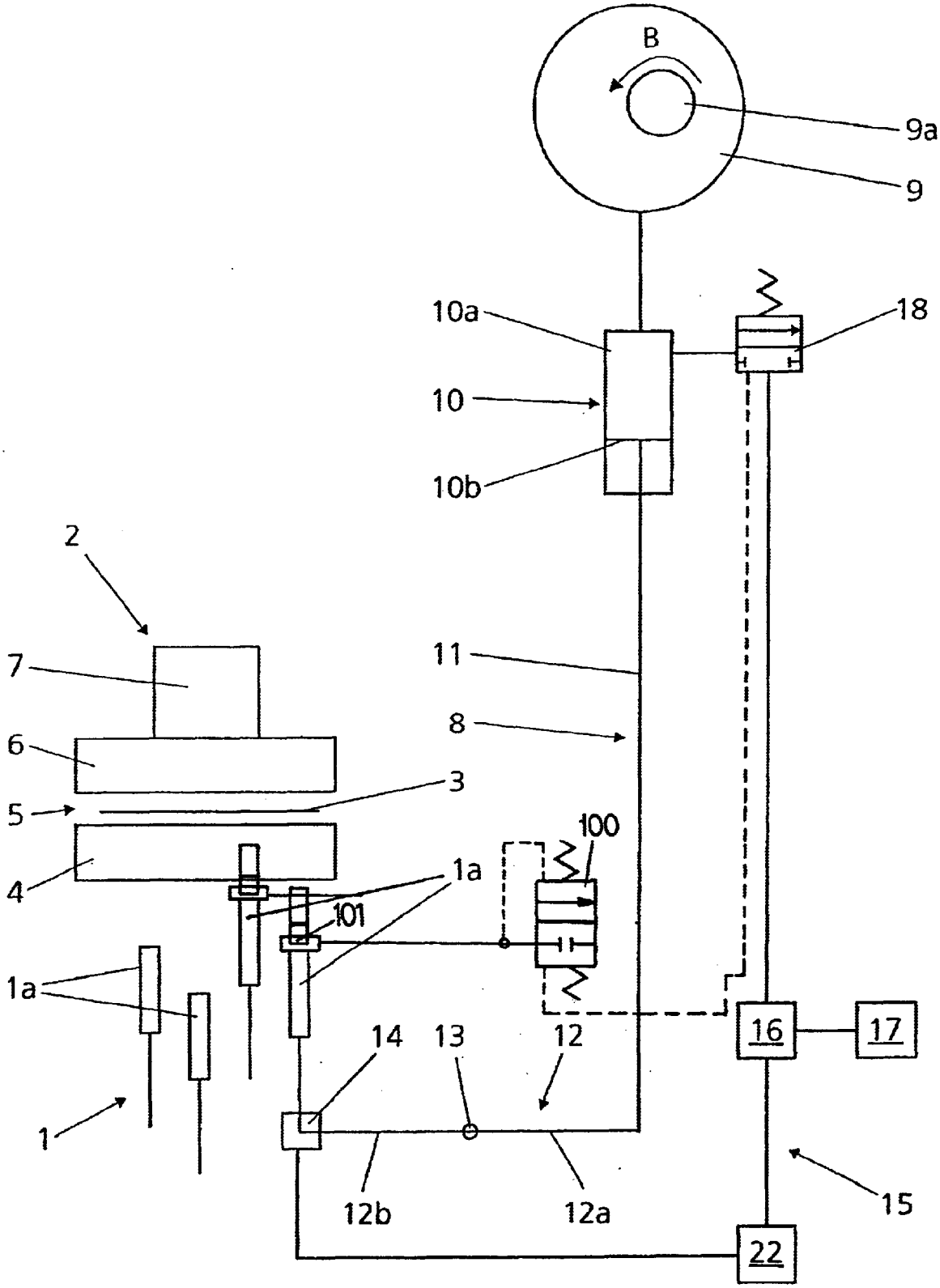
FIG. 2 is an alternate embodiment of the extraction system of FIG. 1.

In an alternative configuration in accordance with FIG. 2, a preliminary relief apparatus 101, constructed as a hydraulic cylinder in the present example, is arranged between the extractor pin 1*a* and measuring sensor 14 in the device in accordance with FIG. 1. The preliminary relief device 101 is relieved through the preliminary relief valve 100, which is arranged between preliminary relief apparatus 101 and valve 18. This takes place in the following manner. Valve 18 is opened through relief of the pressure through valve 100 in the hydraulic cylinder 101. In this way, the pressure in the coupling 10 subsides and is consequently relieved.

Figure 3:
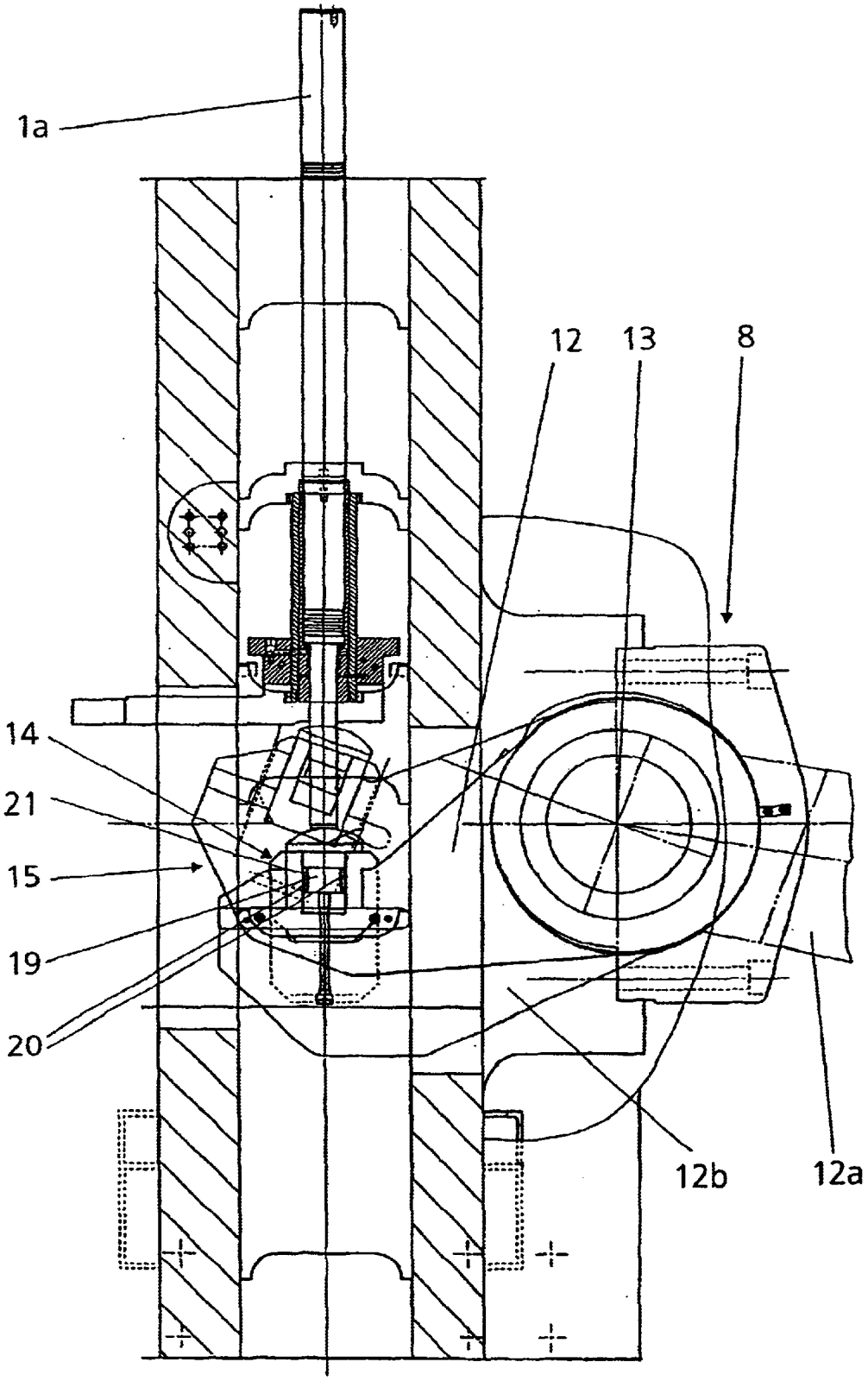
FIG. 3 depicts an extractor element with a part of the associated lever linkage in a first embodiment.

In FIG. 3, the more exact construction and the arrangement of the measuring sensor 14 in the lever linkage 8 is represented. Thus, measuring sensor 14 is comprised by a cylindrical element 19 which is provided with strain gauges 20 on its periphery and which is accommodated in a recess 21 in rocker arm 12. Through strain gauges 20, the force acting on the individual extractor element 1*a* is continuously measured, whereby the connection of the strain gauges 20 with the evaluation apparatus 16 is not explicitly represented in this case. Alternatively, the measuring sensor 14 could also be comprised quartz element arranged within the lever linkage 8. For amplifying the signals of the strain gauges 20, a measuring amplifier 22 is situated between measuring sensor 14 and the evaluation apparatus 16 which operates in an inherently familiar manner. The rocker arm 12 and consequently also the measuring sensor 14 accommodated therein is represented in FIG. 3 in both its end positions.

Figure 4:
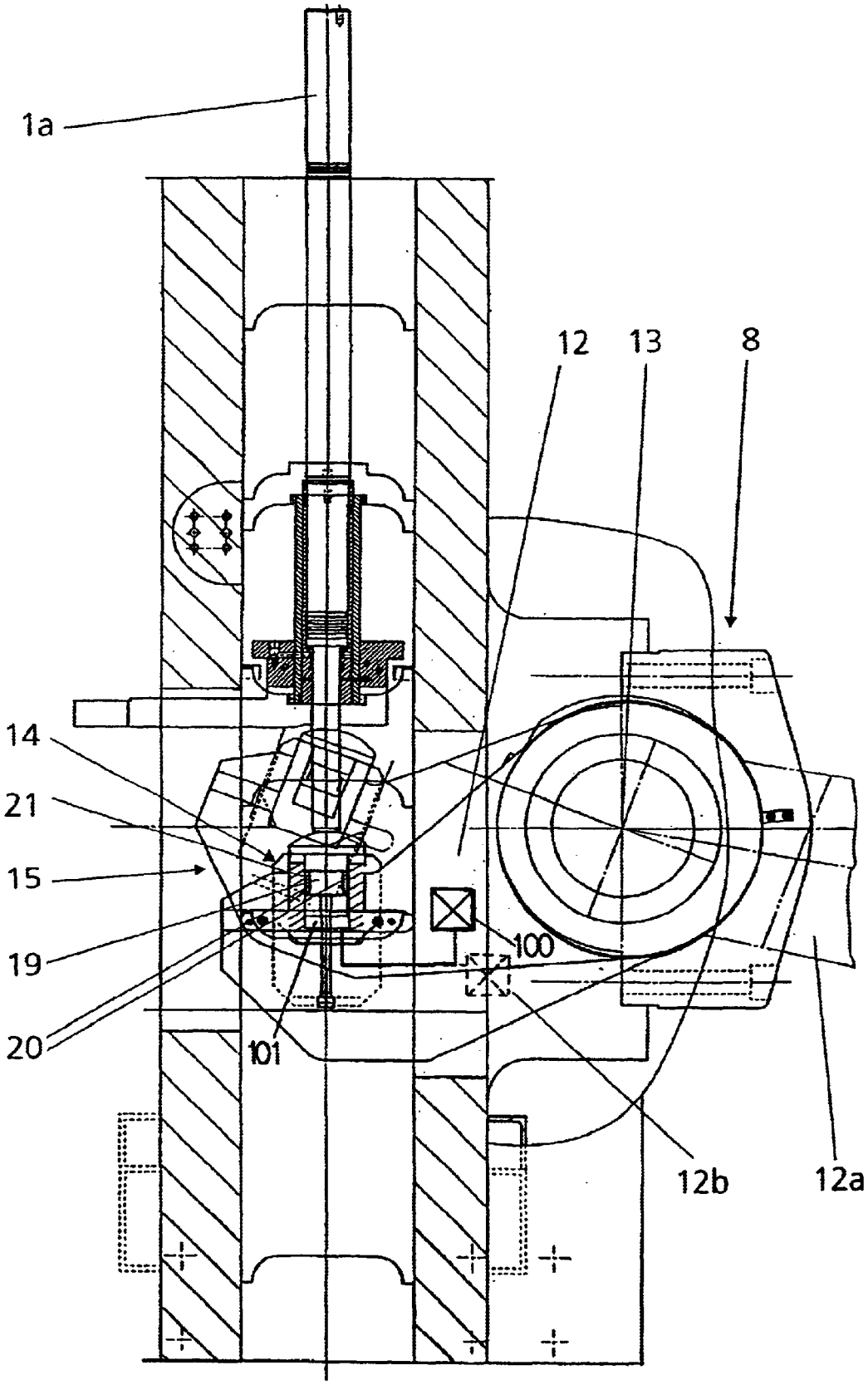
FIG. 4 is a further detailed construction and arrangement of the first embodiment of FIG. 3.

The more exact construction and the arrangement of measuring sensor 14 in lever linkage 8 is represented in FIG. 4. The measuring sensor 14 is thus formed by a cylindrical element 19 which is provided with strain gauges 20 on its periphery and is accommodated in a recess in the rocker arm 12. The force acting on the individual extractor element 1*a* is continuously measured by strain gauges 20, whereby the connection of strain gauges 20 with the evaluating apparatus 16 is not explicitly represented in this case. Alternatively, the measuring sensor 14 can also be formed by a quartz element arranged inside the lever linkage 8. A measuring amplifier 22 which operates in an inherently familiar manner is situated between the measuring sensor 14 and the evaluation device 16 for amplifying the strain gauge 20 signals. The rocker arm 12 and consequently also the measuring sensor 14 accommodated therein is represented in both end positions in FIG. 3. The preliminary relief element 101 is situated between recess 21 and the cylindrical element 19. The preliminary relief valve 100 is connected in series after preliminary relief element 101 and is already described in FIG. 2 and opens valve 18 automatically in the event of an overload.

Figure 5:
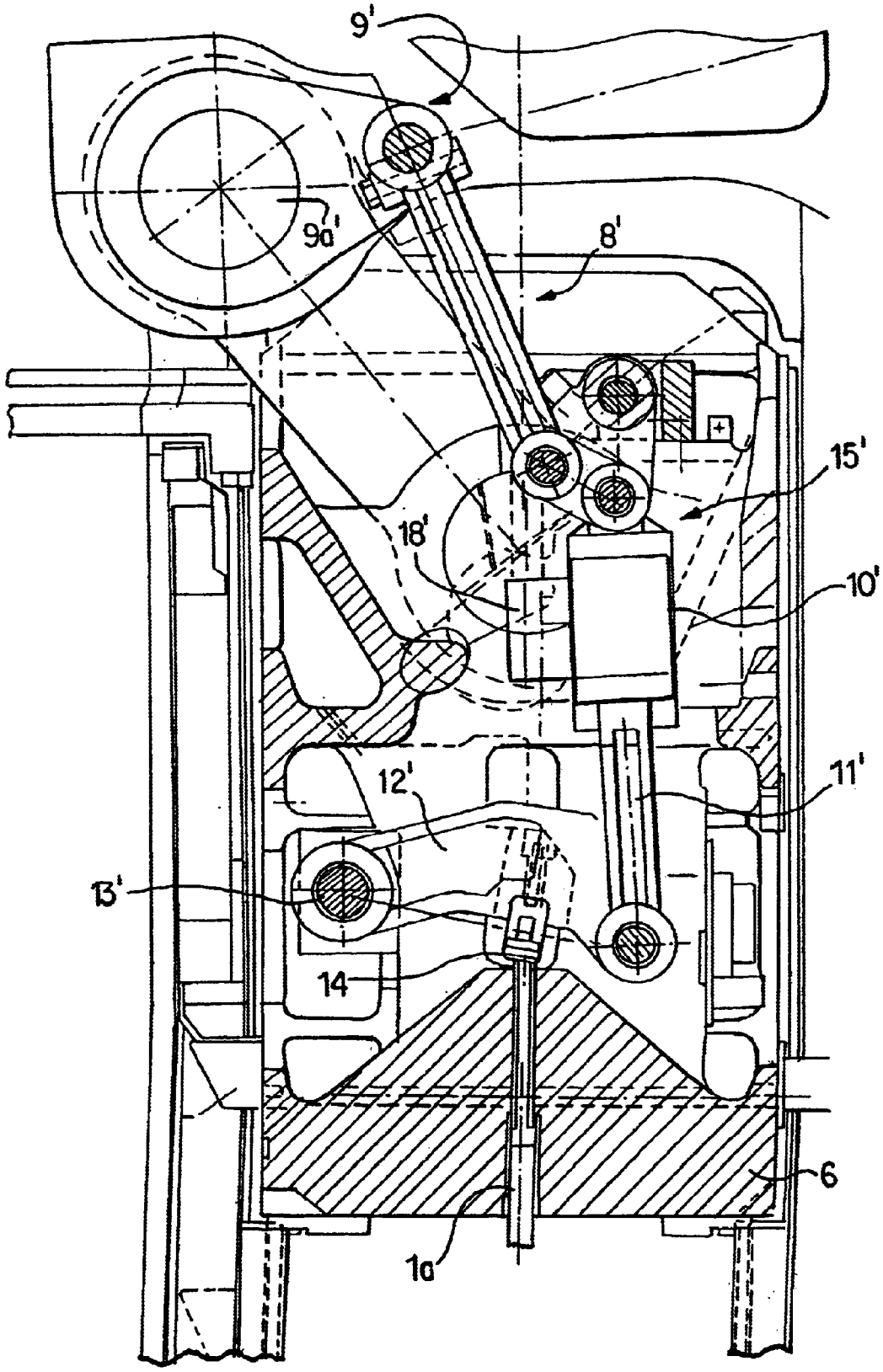

FIG. 5 illustrates an extractor system 1 for the upper tool 6 where the lever linkage 8 is constructed as a toggle linkage 8'. Here too once gain a rocker arm 12' is provided whose point of rotation 13' nonetheless does not lie in the middle as with rocker arm 12 described above, but outside, and indeed on the side facing the actuation lever 11' likewise provided here. Consequently the extractor element 1*a* is actuated by an area of rocker arm 12' which in relation to the mode of functioning of the lever linkage 8' represents no basic change from the embodiment represented in FIG. 3. Here too once again a triggering apparatus 15' is provided which has the components already described above, but which are not completely represented. Coupling 10', which is executed in the form of an inherently known pawl coupling, is in the immediate vicinity of rocker arm 12' arranged in the direction of the flow of force in front of the same and within or in front of the actuation lever 11. Valve 18' is once again directly assigned to coupling 10'.

Since with toggle linkages 8' of this sort, depending on the position of the drive shaft 9*a'* of drive apparatus 9', the force arising on the extractor element 1*a* is not proportional to the force occurring on drive shaft 9*a'*, an adaptation of the force standard values is undertaken for each operating point of the extractor element 1*a* in connection with such a deviation, which is imported into the memory apparatus 17. With the "dynamization" undertaken here, the functions of force or the path of the drive apparatus 9' and the extractor element 1*a* covered are adapted to each other, which once again has effects on the envelopes of the allowable force course.

Figure 6:
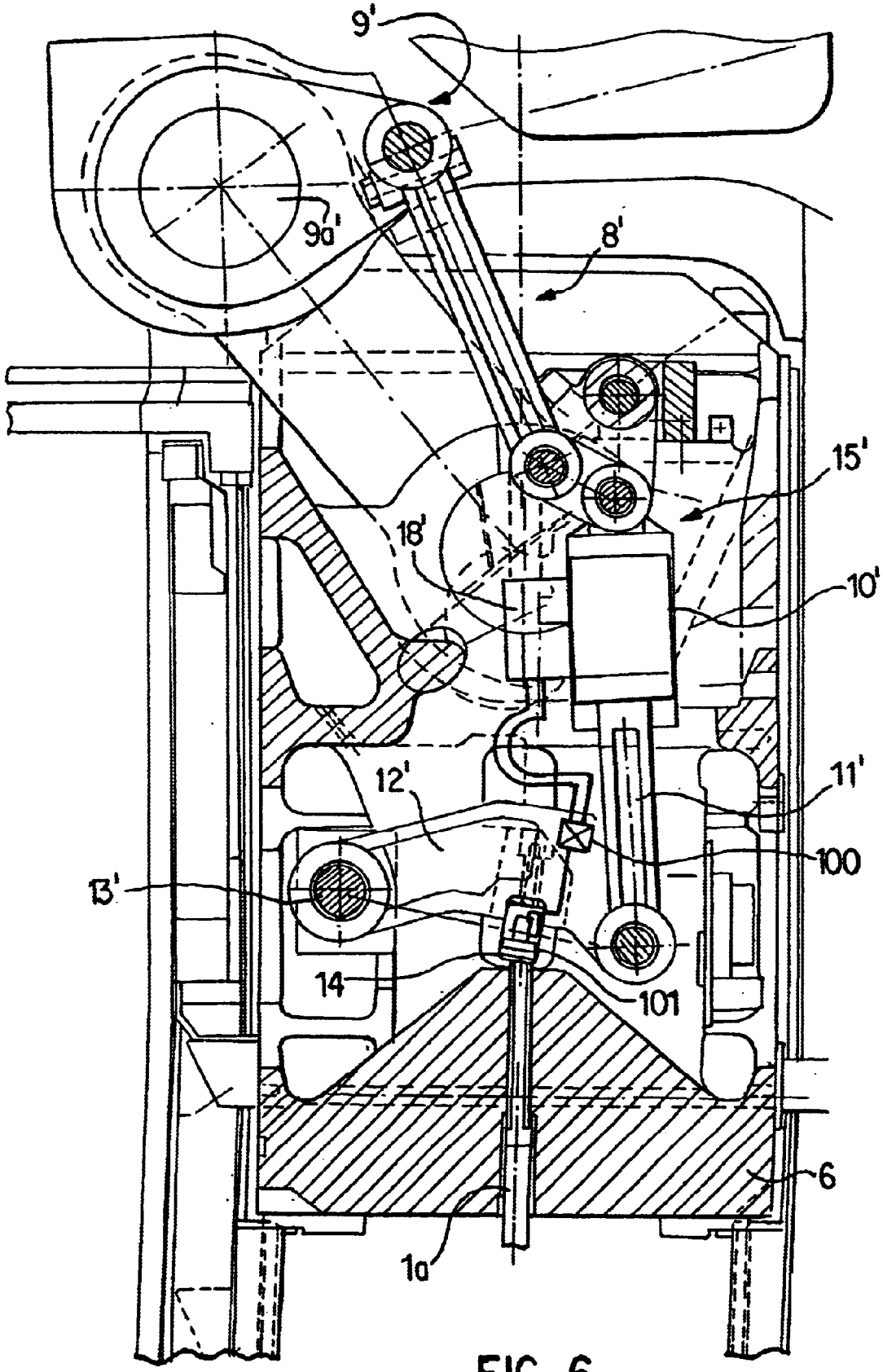
FIG. 6 is a modification of the second embodiment.

As shown in FIG. 6, the preliminary relief device 101 is arranged between rocker arm 12' and measuring sensor 14. As already described in FIG. 2, the preliminary relief valve 100 is connected in series after the preliminary relief device 101 and opens the valve 18 automatically in the event of an excess load above the previously set triggering pressure.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A press for transforming work pieces, comprising:

a drive apparatus for driving at least one press tappet and a plurality of extractor elements for extracting the work pieces after the transforming process wherein said drive apparatus is connected with the extractor elements through a lever linkage;

a tool with a tool lower element and a tool upper element, which is mounted on the press tappet;

a coupling which selectively connects the drive apparatus with the extractor elements, or disengages the drive apparatus from said the extractor elements;

at least one measuring sensor, comprising a triggering apparatus operatively associated with the lever linkage and positioned to measure individually and continuously the force acting on the extractor elements, wherein a triggering apparatus operates to disengage the coupling in the event of a deviation of the force value, measured by at least one measuring sensor from a standard value specified in reference to a specific point of motion of individual ones of the extractor elements by a predetermined amount.

2. The press according to claim 1, wherein the triggering apparatus has at least one evaluation apparatus for evaluating the force values measured by the measuring sensor.

3. The press according to claim 2, wherein within the evaluation apparatus, the force values ascertained by the measuring sensor are compared with force values which are stored in a memory apparatus.

4. The press according to claim 2, wherein, between the measuring sensor and the evaluation apparatus, a measuring amplifier is arranged.

5. The press according to claim 1, wherein the coupling is constructed as a piston/cylinder unit and the triggering unit has a valve through which the coupling is disengageable.

6. The press according to claim 1, wherein the extractor elements are arranged in the tool upper element.

7. The press according to claim 1, wherein the extractor elements are arranged in the tool lower element.

8. The press according to claim 1, wherein the measuring sensor comprises a cylindrical element arranged inside the lever linkage which is provided with strain gauges.

9. The press according to claim 1, wherein the measuring sensor comprises a quartz element arranged inside the lever linkage.

10. The press according to claim 1, wherein a preliminary relief element is arranged between each of the extractor elements and the measuring sensor.

11. The press according to claim 10, wherein a preliminary relief valve is arranged between the preliminary relief element and a valve.

12. A process for transforming work pieces with a tool arranged in a press comprising, extracting the pieces from the tool after the transforming by extractor elements operatively driven through a lever linkage from a drive apparatus, and interrupting the flow of force between the drive apparatus and selected ones of the extractor elements when there is a deviation of the force individually measured with respect to each of the extractor elements from a force standard value specified in reference to a certain point in the motion of the extractor element.

13. The process according to claim 12, wherein, in the event of a change in the force from the drive apparatus acting on the individual extractor elements through the lever linkage, an adaptation of the force standard values is undertaken for selected operating points of the extractor elements to which the change in force occurs.

* * * * *